United States Patent [19]

Lizarraga

[11] Patent Number: 4,815,772

[45] Date of Patent: Mar. 28, 1989

[54] APPARATUS AND METHOD FOR FORMING NECKTIE KNOT

[76] Inventor: Daniel R. Lizarraga, P.O. Box 1018, Florence, Ariz. 85232

[21] Appl. No.: 131,846

[22] Filed: Dec. 11, 1987

[51] Int. Cl.[4] ..... A42B 5/00; B65H 69/04

[52] U.S. Cl. ..... 289/1.5; 2/153; 289/17

[58] Field of Search ..... 289/1.5, 17; 2/144, 2/148, 149, 150, 152 R, 153

[56] References Cited

U.S. PATENT DOCUMENTS 4,572,555 2/1986 Henderson ..... 289/17

4,696,064 9/1987 Morwood ..... 2/144

*Primary Examiner*—Louis K. Rimrodt

*Attorney, Agent, or Firm*—Nissle & Leeds

[57] ABSTRACT

An improved method and apparatus for forming a knot in a necktie. The method comprises utilizing a tool which is shaped and dimensioned to facilitate the wrapping of a free end of the necktie about the other free end to form a knot in the tie. The tool can include inscriptions formed thereon indicating the direction of movement of one free end about the other during formation of a knot in the tie.

3 Claims, 4 Drawing Sheets

APPARATUS AND METHOD FOR FORMING NECKTIE KNOT

This invention relates to a method and apparatus for forming a knot in a necktie.

More particularly, the invention concerns a tool which facilitates learning to tie a necktie knot and which indicates to the user the correct position of one free end of the necktie during wrapping of the free end about the other free end to form the necktie.

In another respect, the invention concerns a method for utilizing a tool to form a four-in-hand or windsor knot in a necktie.

Tying a knot in a necktie, while requiring some minimal skill, is often bothersome and time consuming because the wearer of the necktie has forgotten the correct position and manner of wrapping one free end of the tie about the other free end during formation of the knot in the necktie. When the wearer forgets the correct wrapping sequence used to form a knot in a necktie, the repeated trial-and-error attempts at correctly forming the knot often result in wrinkling of the tie, especially when the tie is fabricated from certain materials, such as silk.

Accordingly, it would be highly desirable to provide a simple means for facilitating a wearer's learning and recalling the proper sequence for wrapping one free end of a tie about the other to form a knot in a necktie.

Another object of the invention is to provide a tool which facilitates a wearer's learning the proper sequence for wrapping one free end of a tie about the other free end to form a knot in the tie.

A further object of the instant invention is to provide a tool of the type described which includes inscriptions formed thereon to indicate the proper direction of movement of one of the free ends of the tie when the tool is held against the juncture of the free ends during the formation of the knot in the necktie.

These and other, further and more specific objects and advantages of the invention will be apparent to those skilled in the art from the following detailed description thereof, taken in conjunction with the drawings, in which.

Figure 1:
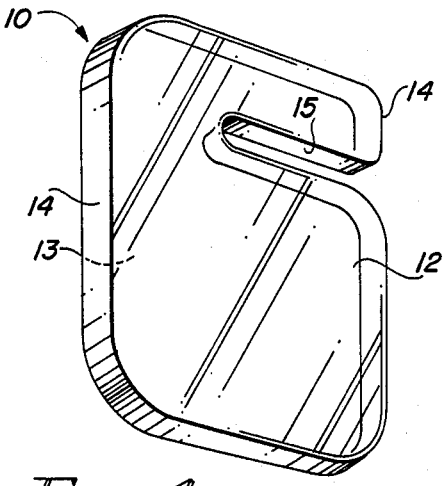
FIG. 1 is a front perspective view of a tool constructed in accordance with the principles of the invention.

Briefly, in accordance with my invention, I provide an improved tool for forming a knot in a four-in-hand necktie. The necktie comprises an elongate strip of fabric which is normally worn by wrapping a portion of the necktie intermediate the free ends thereof around the wearer's neck under the collar of his shirt, forming a knot in the general shape of an inverted, truncated triangle in the portions of the free ends of the necktie extending just past the wearer's collar, allowing the free ends to extend downwardly therefrom in overlapped relationship. The knot forming tool comprises a body having front and rear surfaces and a slot extending through said body from the front to the rear surface. The rear surface of the body is held against the necktie during the wrapping thereof to form the knot. The slot in the body is shaped and dimensioned to receive and guide one of the free ends during the wrapping thereof to form the knot.

In another embodiment of my invention I provide an improved method for forming a knot in a four-in-hand necktie. The necktie comprises an elongate strip of fabric which is normally worn by wrapping a portion of the necktie intermediate the free ends thereof around the wearer's neck under the collar of his shirt, forming a knot in the general shape of an inverted, truncated triangle in the portions of the free ends of the necktie extending just past the wearer's collar, allowing the free ends to extend downwardly therefrom in overlapped relationship. The improved method comprises the steps of wrapping a portion of the necktie around the wearer's neck and crossing the first free end over the second free end to form a juncture therebetween; holding a knot forming tool between the thumb and fingers against the first free end at its juncture with the second free end, the tool including a body having front and rear surfaces terminating at a peripheral edge and a slot extending through the body from the front to the rear surface and opening at the peripheral edge of the body, the rear surface being pressed against the first free end; wrapping the first free end around the second free end, over the front surface of the body and through the slot of the body to form a loop over the juncture of the first and second free ends; passing the first free end upwardly under the juncture and downwardly over the juncture beneath the loop; removing the knot forming tool; and, pulling the first free end downwardly to tighten the loop.

In yet another embodiment of my invention, I provide a tool for use in learning the procedure to form a windsor knot in a necktie, which necktie comprises an elongate strip of fabric which is normally worn by wrapping a portion of the necktie intermediate the free ends thereof around the wearer's neck under the collar of his shirt, forming a knot in the general shape of an inverted, truncated triangle in the portions of the free ends of the necktie extending just past the wearer's collar, allowing the free ends to extend downwardly therefrom in overlapped relationship. The knot forming tool comprises a panel shaped body having an elongate handle; a head attached to the handle; and, inscriptions on the body indicating the proper direction of movement of one of the free ends during the formation of the knot in the tie when the body is held against the necktie during the formation of the knot.

Figure 2:
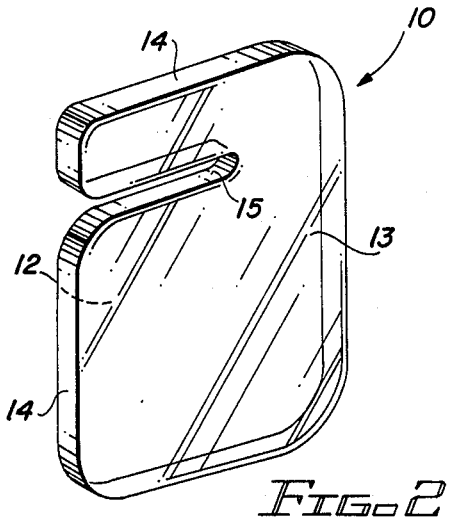
FIG. 2 is a rear perspective view of the tool of FIG. 1.
Figure 5:
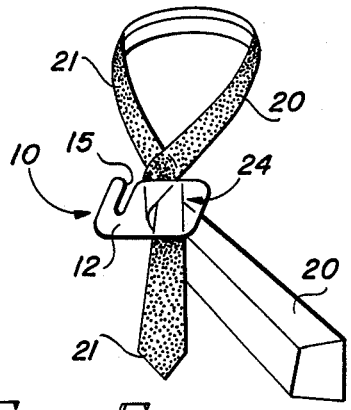
FIGS. 5 to 9 illustrate the formation of a knot in a four-in-hand necktie utilizing the tool of FIGS. 1 and 2; and, FIGS. 10 to 23 illustrate the formation of a knot in a windsor necktie utilizing the tool of FIGS. 3 and 4.
Figure 6:
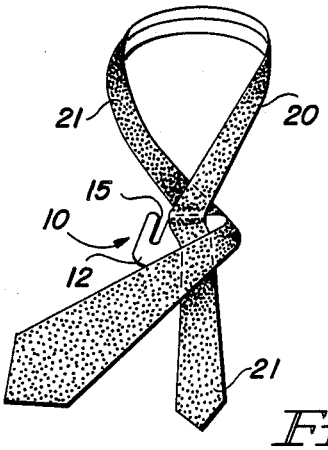
Figure 7:
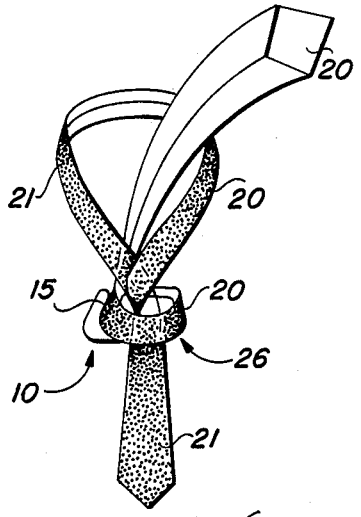
Figure 8:
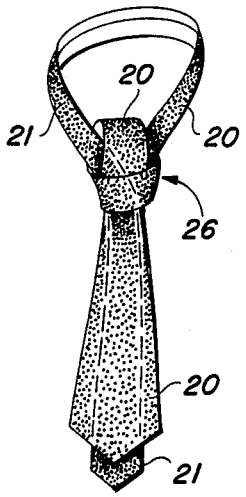
Figure 9:
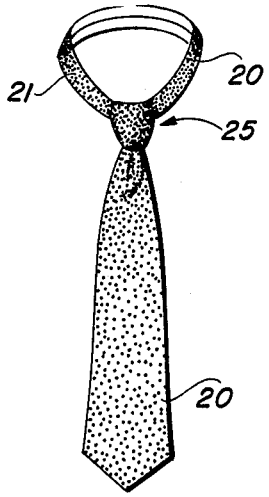

Turning now to the drawings, which depict the presently preferred embodiments of the invention for the purpose of illustrating the practice thereof and not by way of limitation of the scope of the invention, and in which identical reference characters represent corresponding elements throughout the several views, FIGS. 1 and 2 illustrate a tool 10 for use in forming a knot in a four-in-hand necktie. The tool comprises a body including opposed, spaced apart front 12 and rear 13 surfaces co-terminating at a peripheral edge 14. Slot 15 extends through the body from front surface 12 to rear surface 13. Slot 15 opens at peripheral edge 14. The use of the tool of FIGS. 1 and 2 to form a four-in-hand necktie is illustrated in the wrapping sequence of FIGS. 5 to 9. In FIGS. 5 to 9, tool 10 is, for the sake of clarity, assumed to be fabricated from a clear plastic material. In forming the knot in a four-in-hand necktie, free end 20 is crossed over the top of and wrapped behind free end 21 as illustrated in FIG. 5. Tool 11 is then placed against free end 20 at the juncture 24 of ends 21 and 20 in the manner shown in FIG. 5. Tool 10 and the juncture 24 of ends 20 and 21 are ordinarily held between the thumbs and finger of the wearer's hand. Free end 20 is, as depicted in FIG. 6, then wrapped over juncture 24 and over the face 12 of tool 10. In FIG. 7, end 20 has been wrapped around end 21, through slot 15 of tool 10, and upwardly behind the juncture of ends 20 and 21 to form loop 26. After free end 20 has been wrapped around end 21 to the position shown in FIG. 7, tool 10 is removed. After tool 10 is removed, end 20 is downwardly wrapped intermediate the knot forming juncture 24 and loop 26 in the manner depicted in FIG. 8. Knot 25, shown in FIG. 9, is formed by continuing to pull end 20 downwardly in the fashion well known to those of skill in the necktie art.

Tool 10 is advantageous because slot 15 helps control the position of free end 20 and, consequently, aides in the formation of loop 26. Use of tool 10 also serves as a memory aide which facilitates learning the process for forming a four-in-hand necktie.

Figure 3:
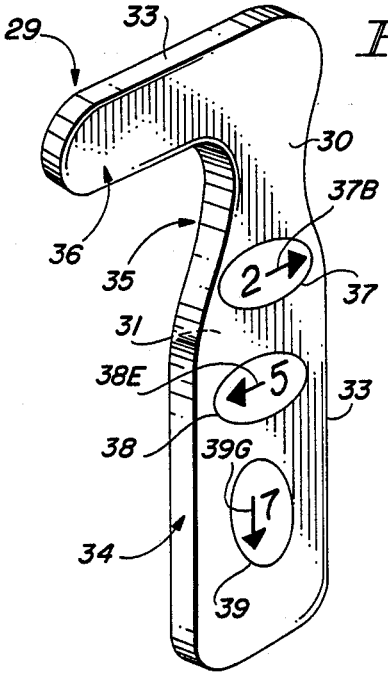
FIG. 3 is a front perspective view of an alternate embodiment of the tool of the invention.

FIGS. 3 and 5 illustrate a tool, generally indicated by reference character 29, utilized in forming a knot in a windsor necktie. The tool comprises a body including opposed, spaced apart front 30 and rear 31 surfaces co-terminating at a peripheral edge 33. Tool 29 includes elongate body 34, neck 35 and head 36. Inscriptions 37, 38, and 39 are formed on front surface 30. Inscriptions 40, 41, 42 and 43 are formed on rear surface 31. As will be described, inscriptions 37 to 43 are utilized by the wearer as a memory aid in learning and recalling how to form a knot in a windsor necktie.

Figure 4:
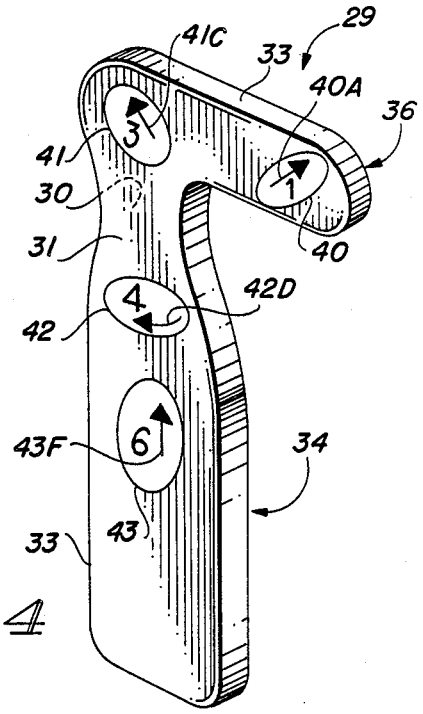
FIG. 4 is a rear perspective view of the tool of FIG. 3.
Figure 10:
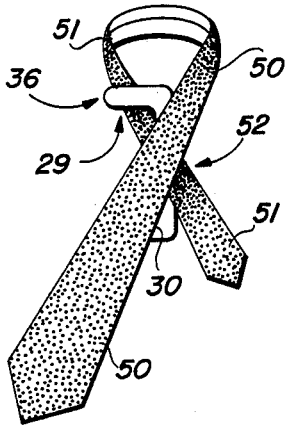
Figure 11:
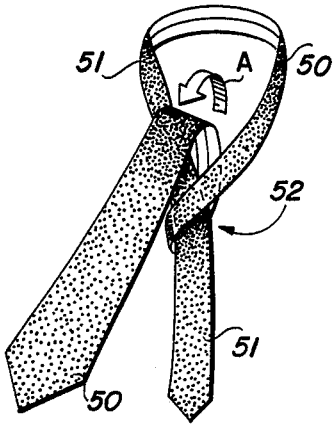
Figure 12:
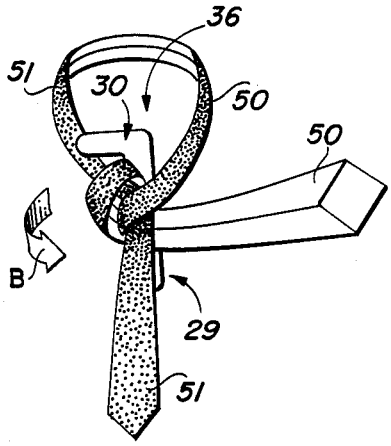
Figure 13:
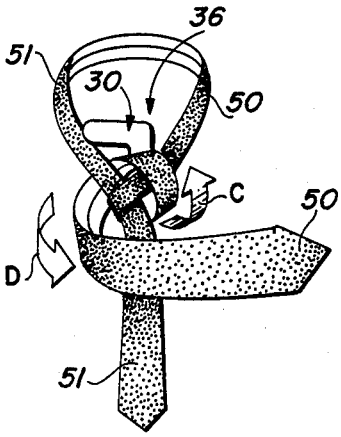
Figure 14:
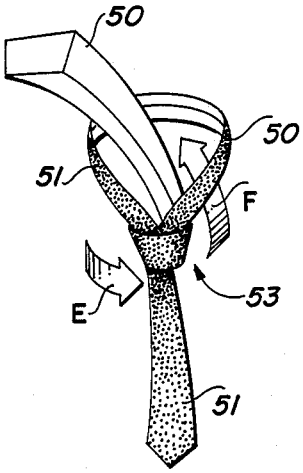
Figure 15:
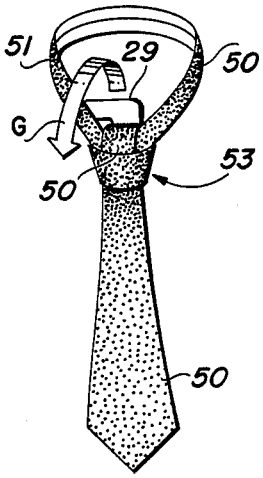

The use of the tool of FIGS. 3 and 4 to form a windsor necktie is illustrated in FIGS. 10 to 15. In forming the knot in a windsor necktie, free end 50 is crossed over the top of free end 51 to form a necktie knot juncture 52 as illustrated in FIG. 10. Tool 29 is positioned behind juncture 52 with the front face 30 contacting free end 51 (see FIG. 10). Tool 29 and juncture 52 are ordinarily held between the thumb and forefinger of the wearer's hand. The wearer holds juncture 52 and tool 29 away from his chest and canted so he can view either the inscriptions 40 to 43 on the rear 31 or front 30 surface of tool 29. After juncture 52 is formed in the manner depicted in FIG. 10, free end 50 is wrapped upwardly behind and over juncture 52 in the direction indicated by arrow A in FIG. 11. The arrow 40A in inscription 40 indicates the direction of travel of free end 50 in FIG. 11. In FIG. 11 free end 50 is wrapped around juncture 52 intermediate tool 20 and juncture 52; consequently, tool 29 is not visible in FIG. 11. In FIG. 12, end 50 is wrapped around end 51 in the direction indicated by arrow B. The arrow 37B in inscription 37 on face 30 indicates the direction of wrapping of end 50 intermediate tool 29 and end 51 in FIG. 12. The wrapping sequence is continued in FIG. 13 where end 50 is moved in the directions indicated by arrows C and D. When end 50 is wrapped in the direction of arrow C up and over juncture 52, arrow 41C in inscription 41 indicates the direction of travel of end 50. When end 50 is wrapped downwardly around end 51 in the direction indicated by arrow D in FIG. 13, arrow 42D in inscription 42 indicates the direction of wrapping of end 50 intermediate tool 29 and juncture 52. In FIG. 14, the wrapping sequence is continued by wrapping end 50 around 51 in the directions indicated by arrows E and F. The movement of end 50 in the direction of arrow E is indicated by arrow 38E of inscription 38, while the movement of end 50 in the direction of arrow F is indicated by arrow 43F of inscription 43. Wrapping end 50 around end 51 in the manner shown in FIG. 14 forms loop 53. In FIG. 15, free end 50 is wrapped downwardly through loop 52 in the direction of arrow G. Movement of end 50 in the direction of arrow G is indicated by arrow 39G in inscription 39. Once free end 50 is in the position indicated in FIG. 15, end 50 can, as is well known by those of skill in the necktie art, be downwardly pulled to tighten loop 53 and form the windsor knot.

As is evident from the foregoing description, the inscriptions on tool 29 serve, when tool 29 is held adjacent the back of juncture 52, as a step-by-step guide indicating the proper direction of movement of free end 50 to form a windsor knot. During use of tool 29 to wrap free end 59 around free end 51, when free end 50 is moved behind juncture 52 free end 50 is wrapped intermediate tool 29 and the back side of juncture 52. In FIG. 10, the front side of juncture 52 is visible while the back side is not.

If desired, portions of tool 29 can be temporarily covered by free end 50 during the formation of the knot in the windsor necktie of FIGS. 10 to 15. For instance, in FIG. 13 free end could be wrapped downwardly in the direction of arrow D over the head 36 of tool 29. After the wrapping step depicted in FIG. 13 was completed, the head 36 of tool 29 could then be removed from beneath end 50 and tool 29 repositioned behind juncture 52. If desired, during the wrapping sequence of FIGS. 10 to 15 tool 29 can be positioned forwardly of juncture 52 in the manner that tool 10 is positioned forwardly of juncture 24.

As would be appreciated by those of skill in the art, the general shape and dimension of tools 20 and 29 can vary widely while still permitting the tools to function in the manner described.

Use of the embodiment of the invention shown in FIGS. 3 and 4 is further illustrated in FIGS. 16 to 23. In FIGS. 16 to 23, the point of view is taken from that of a user utilizing the tool of FIGS. 3 and 4 to tie a windsor knot necktie. Consequently, in FIGS. 16 to 23 the user is looking down at ends 50 and 51 of the tie and arrow 100 and 101 indicate how ends 50 and 51 respectively extend up under the shirt collar of the user and are connected to one another under said collar.

Figure 16:
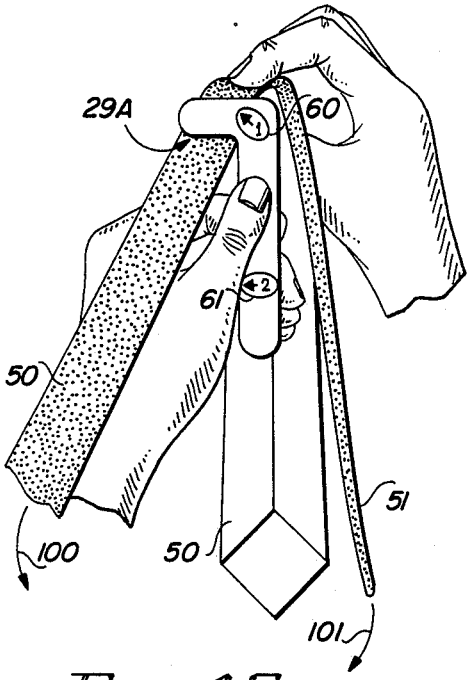
Figure 17:
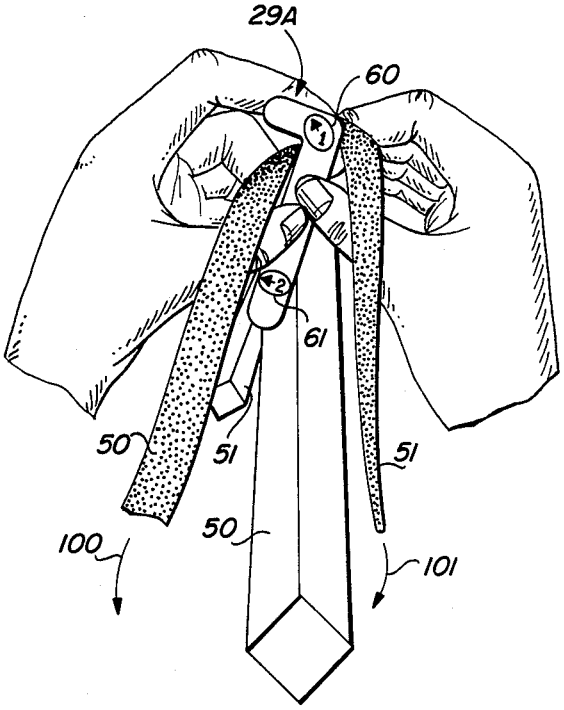
Figure 20:
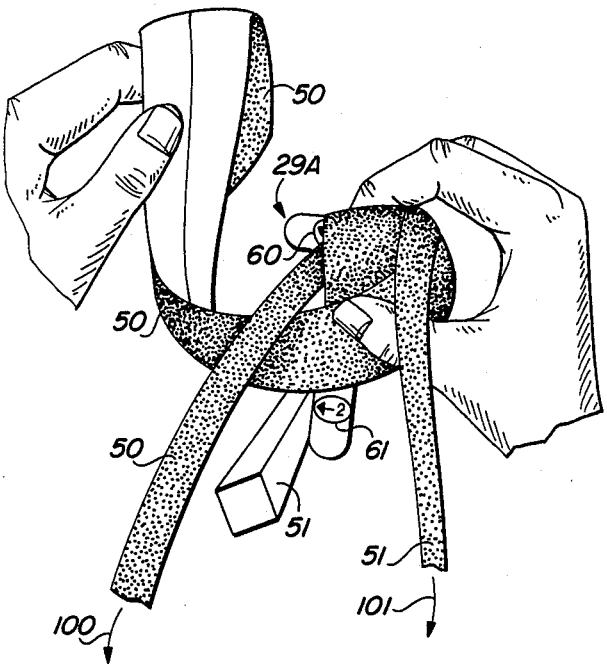
Figure 21:
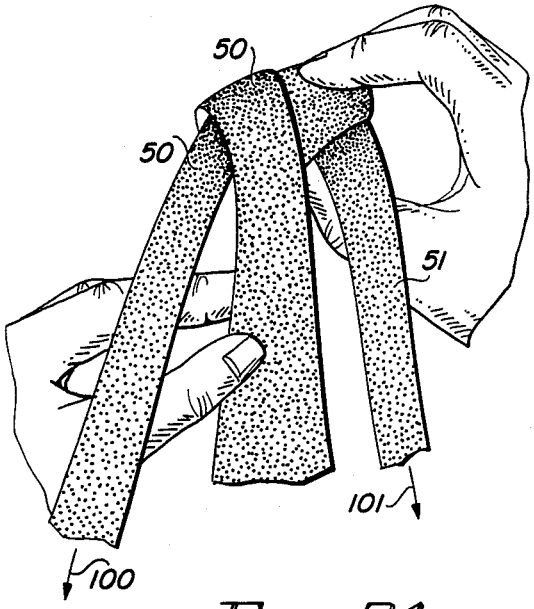
Figure 22:
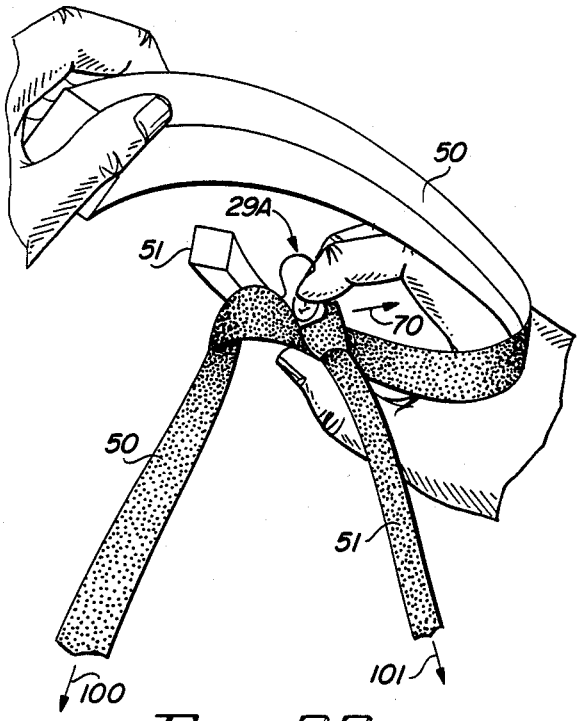
Figure 23:
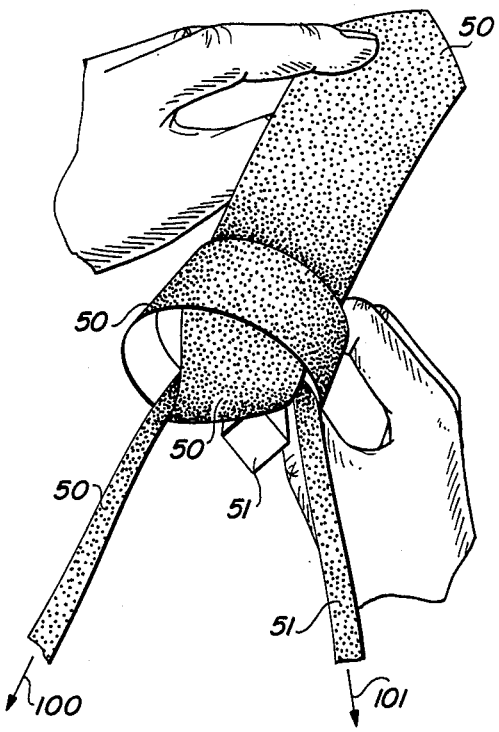

The procedure used in FIGS. 16 to 23 to move the free ends 50, 51 to form a windsor necktie knot is, of course, the same procedure which is used in FIGS. 10 to 15. In FIGS. 16 and 17 the position of the free ends 50 and 51 generally corresponds to the position of free ends 50 and 51 illustrated in FIGS. 10 and 11. Similarly, the position of ends 50 and 51 in FIG. 11; the position of ends 50 and 51 in FIG. 20 is generally equivalent to that of ends 50 and 51 in FIG. 12; the position of ends 50 and 51 in FIGS. 22 is generally equivalent to the ends 50 and 51 in FIG. 13; and, the position of ends 50 and 51 in FIG. 23 is generally identical to that of ends 50 and 51 in FIG. 15.

Further, in FIGS. 16 to 23, the tool 29 is rotated about its longitudinal axis 180° from the position of the tool 29 in FIGS. 10 to 11. The longitudinal axis of tool 29 passes through handle 34. Tool 29A only includes inscriptions 60 and 61.

Figure 18:
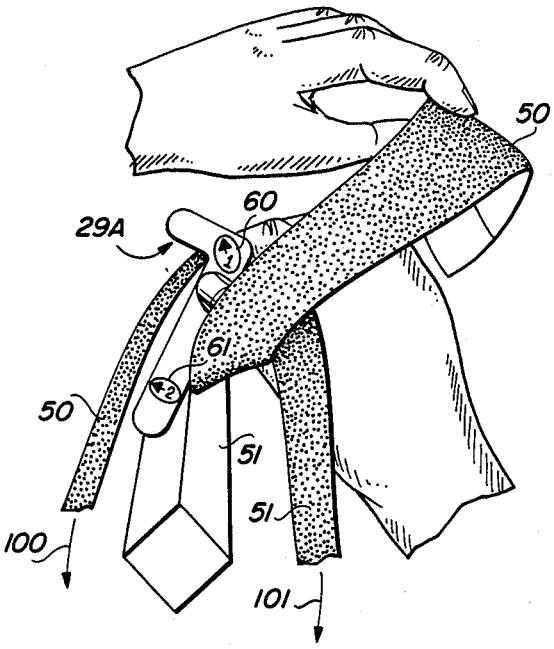
Figure 19:
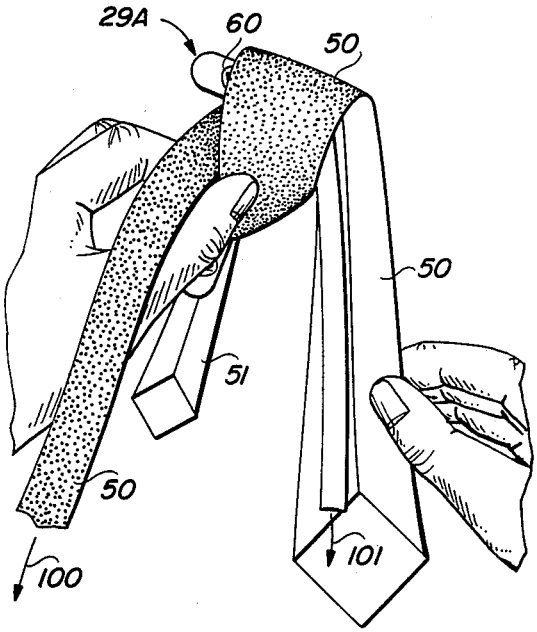

Inscription 60 indicates to the user the movement of end 50 in the manner indicated in FIG. 18. Inscription 61 indicates to the user movement of end 50 in the manner indicated in FIG. 20. It is preferred that after end 50 is moved in the manner indicated in FIG. 22, tool 29A is pulled from the knot in the direction of arrow 70.

Having described my invention in such terms as to enable those skilled in the art to understand and practice it, and having identified the presently preferred embodiments thereof, I claim:

1. A tool for forming a knot in a four-in-hand necktie, which necktie comprises an elongate strip of fabric which is normally worn by wrapping a portion of the necktie intermediate the free ends thereof around the wearer's neck under the collar of his shirt, forming a knot in the general shape of an inverted, truncated triangle in the portions of the free ends of said necktie extending just past the wearer's collar, allowing said free ends to extend downwardly therefrom in overlapped relationship, said knot forming tool comprising a body having front and rear surfaces and a slot extending through said body from said front to said rear surface, said rear surface being held against said necktie during the wrapping thereof to form said knot, said slot being shaped and dimensioned to receive and guide one of said free ends during the wrapping thereof to form said knot.

2. A method for forming a knot in a four-in-hand necktie, which necktie comprises an elongate strip of fabric which is normally worn by wrapping a portion of the necktie intermediate the free ends thereof around the wearer's neck under the collar of his shirt, forming a knot in the general shape of an inverted, truncated triangle in the portions of the free ends of said necktie extending just past the wearer's collar, allowing said free ends to extend downwardly therefrom in overlapped relationship, said method comprising the steps of (a) wrapping a portion of the necktie around the wearer's neck and crossing the first free end over the second free end to form a juncture therebetween;

(b) holding a knot forming tool between the thumb and fingers against said first free end at its juncture with said second free end, said tool including a body having front and rear surfaces terminating at a peripheral edge and a slot extending through said body from said front to said rear surface and opening at said peripheral edge of said body, said rear surface being pressed against said first free end;

(c) wrapping said first free end around said second free end, over said front surface and through said slot of said body to form a loop over said juncture of said first and second free ends;

(d) passing said first free end upwardly under and downwardly said juncture beneath said loop;

(e) removing said knot forming tool; and, (f) pulling said first free end downwardly to tighten said loop.

3. A tool for use in learning the procedure to form a knot in a windsor necktie, which necktie comprises an elongate strip of fabric which is normally worn by wrapping a portion of the necktie intermediate the free ends thereof around the wearer's neck under the collar of his shirt, forming a knot in the general shape of an inverted, truncated triangle in the portions of the free ends of said necktie extending just past the wearer's collar, allowing said free ends to extend downwardly therefrom in overlapped relationship, said knot forming tool comprising a panel shaped body having (a) an elongate handle;

(b) a head attached to said handle; and, (c) inscriptions on said body indicating the proper direction of movement of one of said free ends during the formation of said knot in said tie when said body is held against said necktie during the formation of said knot.

* * * * *